United States Patent [19]

Nagakura et al.

[11] Patent Number: 5,062,399

[45] Date of Patent: Nov. 5, 1991

[54] PISTON PROTECTION SYSTEM FOR INTERNAL COMBUSTION ENGINE

[75] Inventors: Hodaka Nagakura; Tsuneshi Kondo, both of Hamamatsu, Japan

[73] Assignee: Sanshin Kogyo Kabushiki Kaisha, Hamamatsu, Japan

[21] Appl. No.: 514,729

[22] Filed: Apr. 26, 1990

[30] Foreign Application Priority Data

Apr. 26, 1989 [JP] Japan ..... 1-106842

[51] Int. Cl.[5] ..... F02B 77/00

[52] U.S. Cl. ..... 123/198 D; 123/435

[58] Field of Search ..... 123/73 AD, 198 D, 198 DB, 123/198 DC, 196 S, 435

[56] References Cited

U.S. PATENT DOCUMENTS

Re. 32,577 1/1988 Dubois ..... 123/73 AD
4,243,009 1/1981 Staerzl ..... 123/435
4,535,739 8/1985 Kudo et al. ..... 123/435
4,667,637 5/1987 Staerzl ..... 123/435
4,829,956 5/1989 Rehn et al. ..... 123/198 DC

*Primary Examiner*—Noah P. Kamen
*Attorney, Agent, or Firm*—Ernest A. Beutler

[57] ABSTRACT

A method and an apparatus for protecting an engine from damage due to such factors as piston scuffing and/or knocking. The vibration of the engine is measured and vibrational thresholds indicative of either engine knocking or piston scuffing are generated and the actual engine conditions compared with those criteria. If either knocking or piston scuffing are predicted to occur, protective action is taken by either shutting the engine down, reducing its speed and/or providing additional lubrication for the engine. When protective action is taken, a warning is also given to the operator of a detrimental condition.

20 Claims, 6 Drawing Sheets

PISTON PROTECTION SYSTEM FOR INTERNAL COMBUSTION ENGINE

BACKGROUND OF THE INVENTION

This invention relates to a piston protection system for an internal combustion engine and more particularly to an improved apparatus and method for predicting when an engine may be operating in a detrimental state and taking steps to prevent damage to the engine.

It is known to employ knock detectors with internal combustion engines so as to sense when a knocking condition is occurring and take precautionary steps to reduce or stop this knocking. However, in addition to engine knocking, there are other operating conditions that can cause detrimental operation. For example, it is known that the forces on the piston during its reciprocation are such that the piston tends to rock about the piston pin and can scuff the cylinder walls. Under extreme conditions, damage to either the piston and/or cylinder walls can occur. In fact, under extremely aggravated situations, there can actually occur seizure of the piston in the cylinder bore.

Previously, it has been the practice to try to limit the speed of the engine so as to reduce the likelihood of damage under this situation. However, the protection against this problem has always had to be in the basic design of the engine. That is, it was heretofore impossible to predict when the engine running conditions were such that piston or cylinder bore damage of the aforenoted type might occur. It has been discovered, however, that sensing of the vibrations of the engine itself can be predictable in indicating when the engine is operating in a condition that such piston/cylinder bore damage might occur. It has been found that by measuring the vibrations of the engine and comparing them with known or predicted data, protective steps can be taken which will reduce the likelihood of such damage.

It is, therefore, a principal object of this invention to provide a method and apparatus for predicting when engine operating conditions can reach a detrimental stage and taking precautionary steps before damage occurs.

It is a further object of this invention to provide a method and apparatus for detecting the possible occurrence of piston/cylinder bore damage and taking measures to protect against such damage during the engine running.

SUMMARY OF THE INVENTION

This invention is adapted to be embodied in a control system for protecting a reciprocating engine from damage that comprises means for detecting vibration of the engine. Means are provided for comparing the vibration measured with those predicted to cause detrimental operation. In the event the measured vibration indicates the approach of a condition when detrimental operation might occur, means are provided for initiating protective operation to preclude damage.

The invention is also adapted to be embodied in a method for protecting a reciprocating engine from damage that comprises the steps of measuring the vibrations of the engine and comparing the measured vibrations with those predicted to cause detrimental operation. If the measured vibrations approach those at which detrimental operation may occur, protective operation of the engine is initiated.

DETAILED DESCRIPTION OF THE PREFERRED EMBODIMENTS OF THE INVENTION

Figure 1:
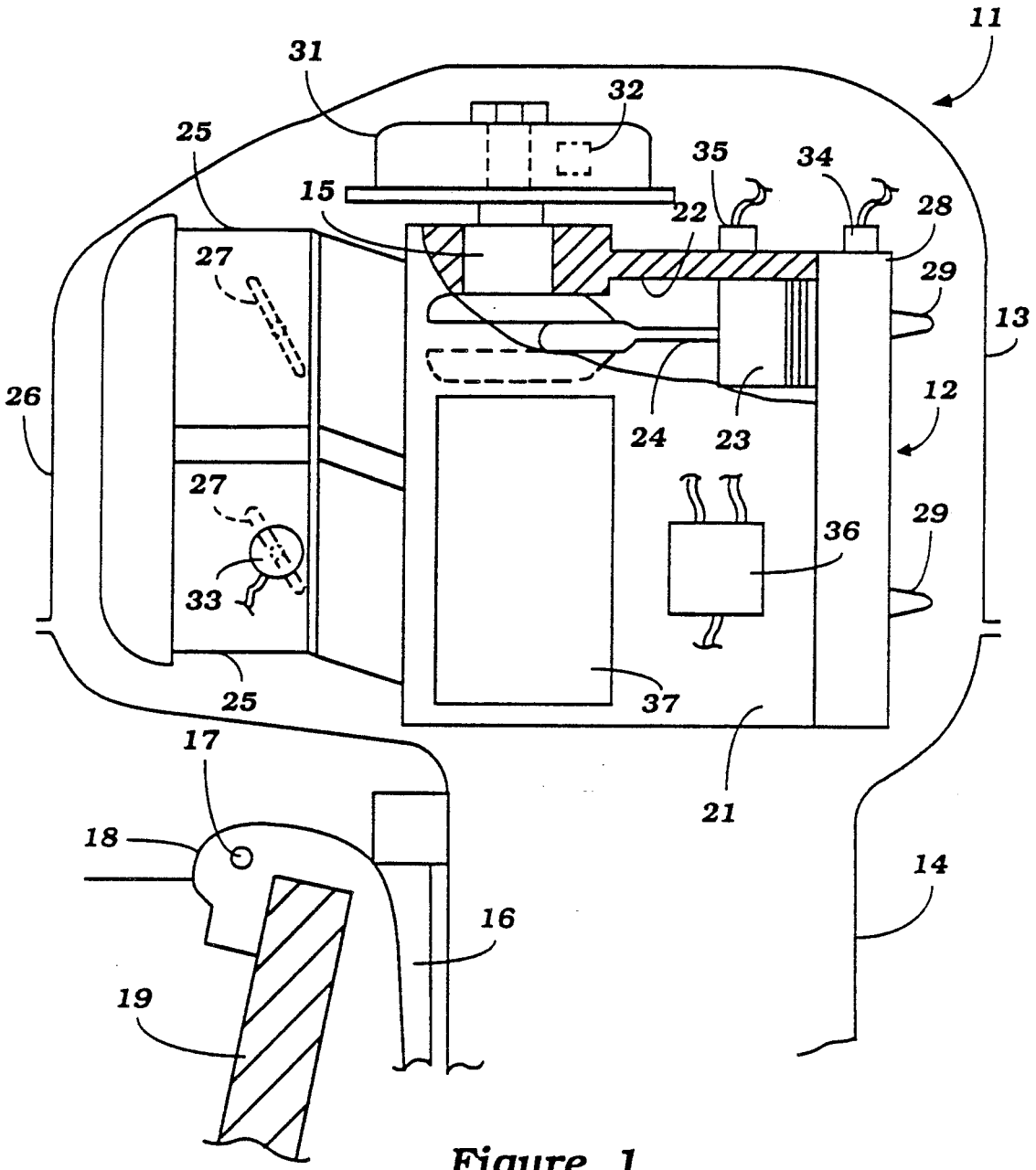
FIG. 1 is a partial side elevational view of an outboard motor attached to the transom of an associated watercraft, with portions broken away and other portions shown in section.

Referring first to FIG. 1, an outboard motor is illustrated partially and is identified generally by the reference numeral 11. The invention is described in conjunction with an outboard motor because such outboard motors are typical examples of applications of reciprocating internal combustion engines and this invention relates to an arrangement for protecting such engines from damage. Also, the invention has particular utility with two cycle engines due to their more frequent firing impulses and two cycle engines are typically employed as the power plants for outboard motors. Of course, the invention has application with four cycle engines and, as noted, other applications for reciprocating engines.

The outboard motor 11 is comprised of a power head that includes a powering internal combustion engine 12 and a surrounding protective cowling 13. In the illustrated embodiment, the engine 12 is of the two cylinder crankcase compression two cycle type. It will be readily apparent to those skilled in the art, however, that the invention can be utilized with other types of reciprocating engines.

The outboard motor includes a drive shaft housing, shown partially at 14, that contains a drive shaft driven by an engine crankshaft 15 and which drives a propulsion unit carried by a lower unit which is not shown, since, as has been noted, the invention relates to the construction of the engine 12 and the manner in which it is protected from damage. A swivel bracket 16 is pivotally connected by a pivot pin 17 to a clamping bracket 18 which, in turn, is affixed to a transom 19 of an associated watercraft. The construction of the outboard motor 11, except for the engine protection system to be described, may be considered to be conventional. For that reason, further details of the construction of the outboard motor are not believed to be necessary to understand the invention.

The engine 12 includes a cylinder block 21 having a pair of aligned horizontally disposed cylinder bores 22, only one of which appears in the drawings, in which pistons 23 are supported for reciprocation. The pistons 23 are connected by means of connecting rods 24 to the crankshaft 15 for driving it in a known manner.

A fuel/air charge is delivered to sealed crankcase chambers of the engine, as is typical with two cycle practice, from carburetors 25. The carburetors 25 draw air from an inlet device 26 and create a fuel/air mixture that is delivered to the crankcase chambers of the engine, as aforenoted. The carburetors 25 are equipped with throttle valves 27 that are manually controlled so as to control the speed of the engine, as is well known. The fuel/air charge delivered to the crankcase chambers is transferred through scavenge passageways (not shown) to combustion chambers formed above the pistons 23 by a cylinder head assembly 28. The cylinder head assembly 28 is affixed to the cylinder block 21 and carries spark plugs 29 for firing this charge. The burnt charge then drives the pistons 23 downwardly and is discharged through an exhaust system (not shown).

A flywheel magneto, indicated generally by the reference numeral 31 is affixed to the upper end of the crankshaft 15 and includes a pulser coil 32 for firing the spark plugs 29 through an appropriate spark plug circuit. The pulser coil 3 in addition to firing the spark plugs 29 outputs a signal that is indicative of engine speed, which signal is utilized for engine control in a manner which will be described.

In addition to the pulser coil 32, the engine 12 is provided with further instrumentation for the engine control. This further instrumentation includes a throttle position sensor 33 that is associated with one of the throttle valves 27 and provides an indication of throttle opening and, accordingly, air flow to the engine. Alternatively to the use of the throttle position sensor 33, an actual intake air flow detector may be employed. A temperature sensor 34 is carried by the cylinder head 28 for detecting engine temperature. Also, a vibration detector 35 is suitably affixed to the engine, such as to the cylinder block and also outputs signals indicative of engine vibration.

The engine 12 is provided with a separate lubricating system including a lubricant pump 36 which is driven by the engine and which draws lubricant from a lubricant reservoir (not shown) and delivers it to the engine for its lubrication. This lubricant may be sprayed into the intake manifolds connecting the carburetors 25 to the crankcase chambers and/or directly to certain components of the engine to be lubricated. The lubricating system, although it forms no part of the invention per se and any conventional type of lubricating system may be utilized, does function in the control for protecting the engine 12 as will be described.

Figure 2:
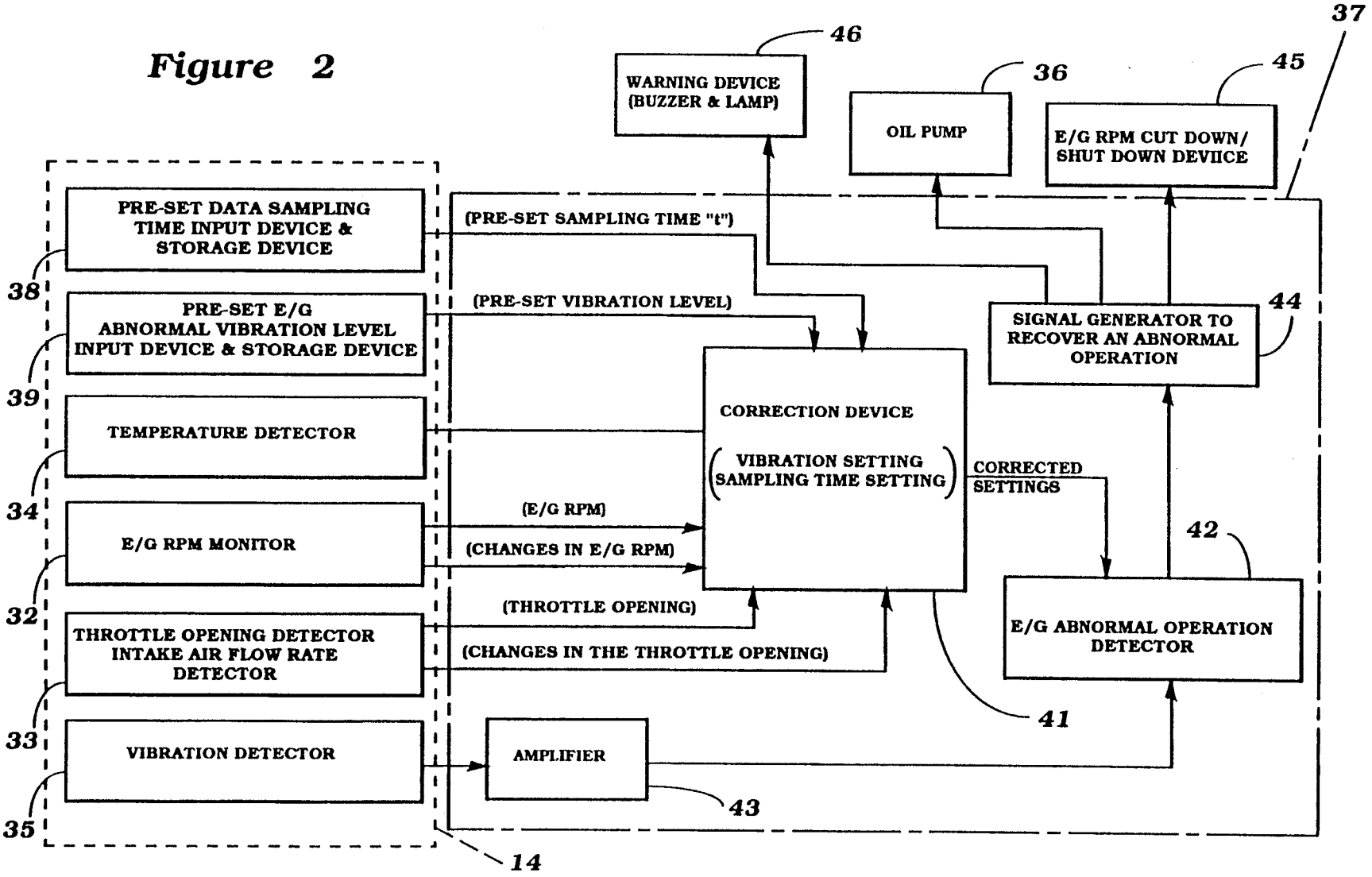
FIG. 2 is a schematic block diagram showing the components of the system.

A control box, indicated generally by the reference numeral 37 is mounted on the side of the cylinder block 21 and carries the controls for protecting the engine which may be best understood by reference to FIG. 2. The control 37 receives the input signals from the engine speed monitor or pulser coil 32, the throttle position or air flow detector 33, the temperature detector 34 and the vibration detector 35. In addition, there are provided certain input presets such as a preset data sampling time input device and storage device 38 which inputs certain data to the control 37 as will be discussed and a preset engine abnormal vibration level input device and storage device 39. These devices 38 and 39 may be separate components or may, in fact, comprise components of the control 37.

The outputs from the engine speed detector or pulser coil 32, throttle opening or air flow detector 33 and temperature detector 34 are all transmitted to a correction device that adjusts the vibration setting which is indicative of an abnormal engine condition, as will be hereinafter described. This correction device is indicated by the reference numeral 41. In addition, data from the presets 38 and 39 are also transmitted to the correction device 41. The correction device 41 outputs the corrected abnormal vibration condition signals to an abnormal engine operation detector 42. The detector 42 is, in effect, a comparator which compares the actual measured signals, as transmitted to it, from the vibration detector 35 through an amplifier 43 with the values which indicate abnormal conditions, as will be hereinafter described.

The abnormal engine operating condition detector 42 will output a signal to a control signal generator 44 in the event of the detection of an abnormal condition which can be detrimental to the engine operation. The device 44 then activates, under certain circumstances, the oil pump 36 to supply additional lubricant to the engine and also an ignition control device 45 which functions to either reduce the engine speed through selective misfiring of the spark plugs 29 by controlling the ignition circuit or actually stopping the running of the engine. In addition, a warning device 46 such as a buzzer and/or lamp are activated when the abnormal condition is sensed.

Figure 3:
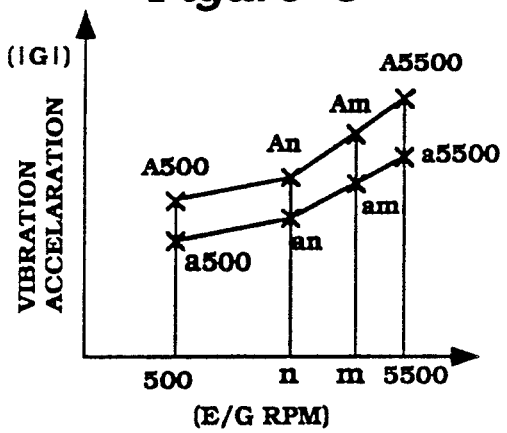
FIG. 3 is a graphic view showing engine speed versus vibration accelerations in the engine and the relation of these to certain detrimental conditions.
Figure 4:
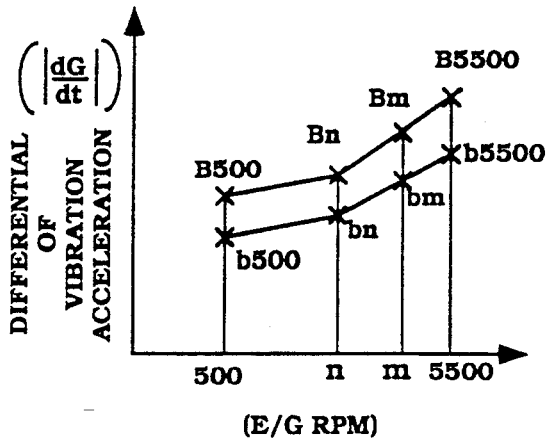
FIG. 4 is a graphic view showing the differential of vibration acceleration relative to engine speed and shows a pair of curves representing certain types of detrimental action.

As has been previously noted, it has been determined that engine vibration not only is indicative of engine knocking, a combustion phenomenon, but also is indicative of a condition when piston scuffing can occur due to the piston rock about the piston pin axis caused by the forces acting on the piston due to the angle of the connecting rod 24 and the gas pressures acting on the piston 23. FIGS. 3 and 4 are graphic views that show the relationship of various vibration characteristics to engine speed and the curves at which detrimental operation will occur.

FIG. 3 is a graphic view showing vibration acceleration G in relation to engine speed. There is a first curve including the points $A_{500}$, $A_n$, $A_m$ and $A_{5500}$ which represent the engine speeds 500 RPM, n RPM, m RPM and 5500 RPM, respectively, which are indicative of vibration acceleration figures which will indicate the existence of a condition under which piston suffing is likely to occur. In addition, there is the curve containing the points $a_{500}$, $a_n$, $a_m$ and $a_{5500}$ which indicate the vibration acceleration conditions under which knocking is likely to occur.

In a similar manner, FIG. 4 shows a curve of the differential of vibration acceleration dg/dt with the points B and b representing the curves under which piston scuffing or knocking may occur.

Figure 9:
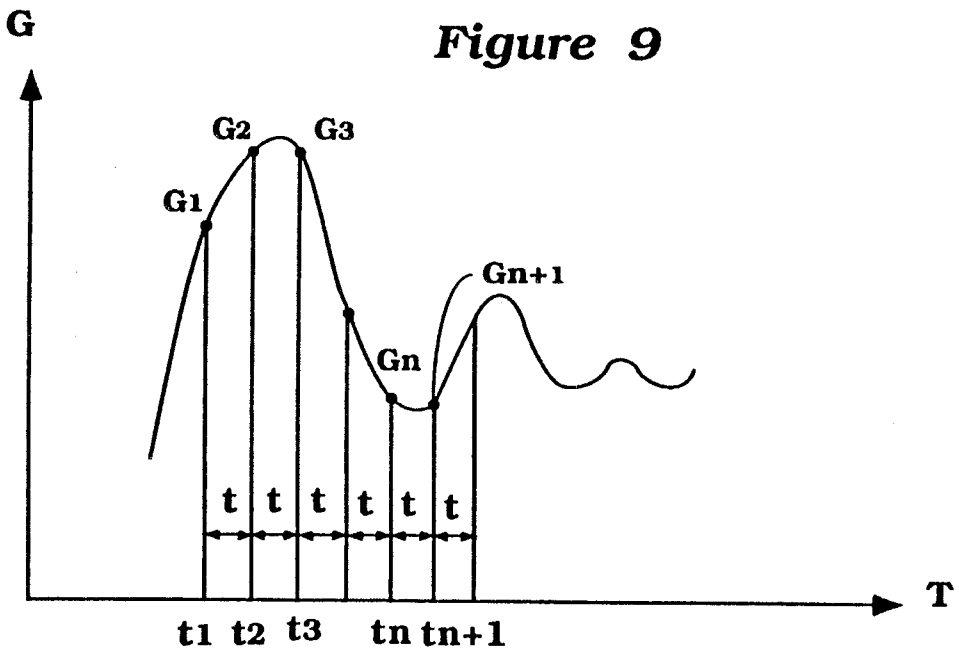
FIG. 9 is a graphic view showing vibration acceleration as sampled during the running of the engine by the computer.

Certain of the points on the curves of FIGS. 3 and 4 may be actually determined through engine testing whereas other points may be predicted from the computer or control unit 37 as may be understood by reference to FIG. 9. FIG. 9 is a graphic view showing the condition when piston rock becomes aggravated and the piston scuffing will actually occur. It should be readily apparent as piston rock is aggravated, the piston will interfere with the cylinder bore, as aforedescribed, to cause a scuffing action that will actually dampen itself. However, in extreme cases the motion may actually cause the piston to seize in the cylinder bore. It should be noted that this phenomenon and sample readings can be taken by the computer at points $G_1$, $G_2$, $G_3$ at successive times $t_1$, $t_2$ and $t_3$ along the length of the curve progressing to the points Gn and Gn+1. Hence, the computer can actually with the aforedescribed data indicate that detrimental conditions may occur.

Figure 6:
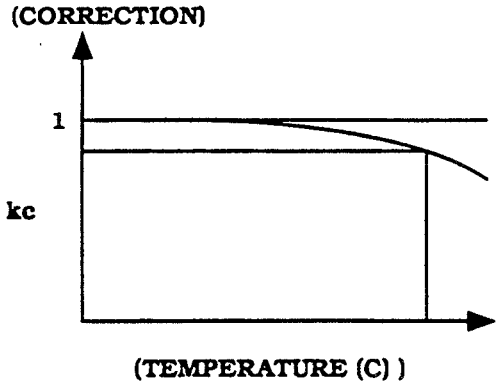
FIG. 6 is a graphic view showing the correction factor kc relative to engine temperature in degrees Celsius.

It is also known that the threshold values on the curves shown in FIGS. 3 and 4 will vary with conditions such as engine temperature. That is, as the engine temperature increases, so increases the likelihood for engine damage. Hence, a correction curve as shown in FIG. 6 is applied, using a correction constant kc which varies with engine temperature.

Figure 7:
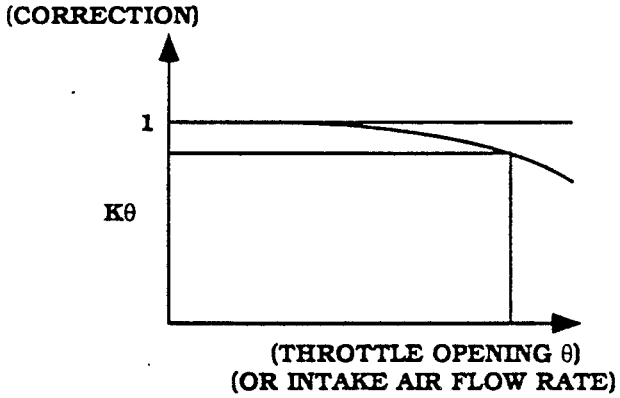
FIG. 7 is a graphic view showing the correction factor $k\theta$ in relation to throttle opening $\theta$ or air intake flow.

In addition, as throttle opening or air intake flow increases, it is also likely that detrimental conditions can occur under lower vibrations. Hence a correction factor $k\theta$ is applied as derived from the curve shown in FIG. 7.

Figure 8:
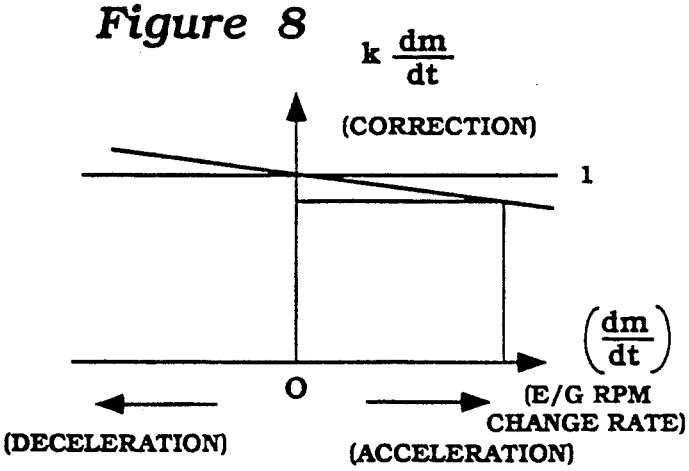
FIG. 8 is a graphic view showing the correction factor kdm/dt with respect to engine rate of speed change (acceleration or deceleration).
Figure 5:
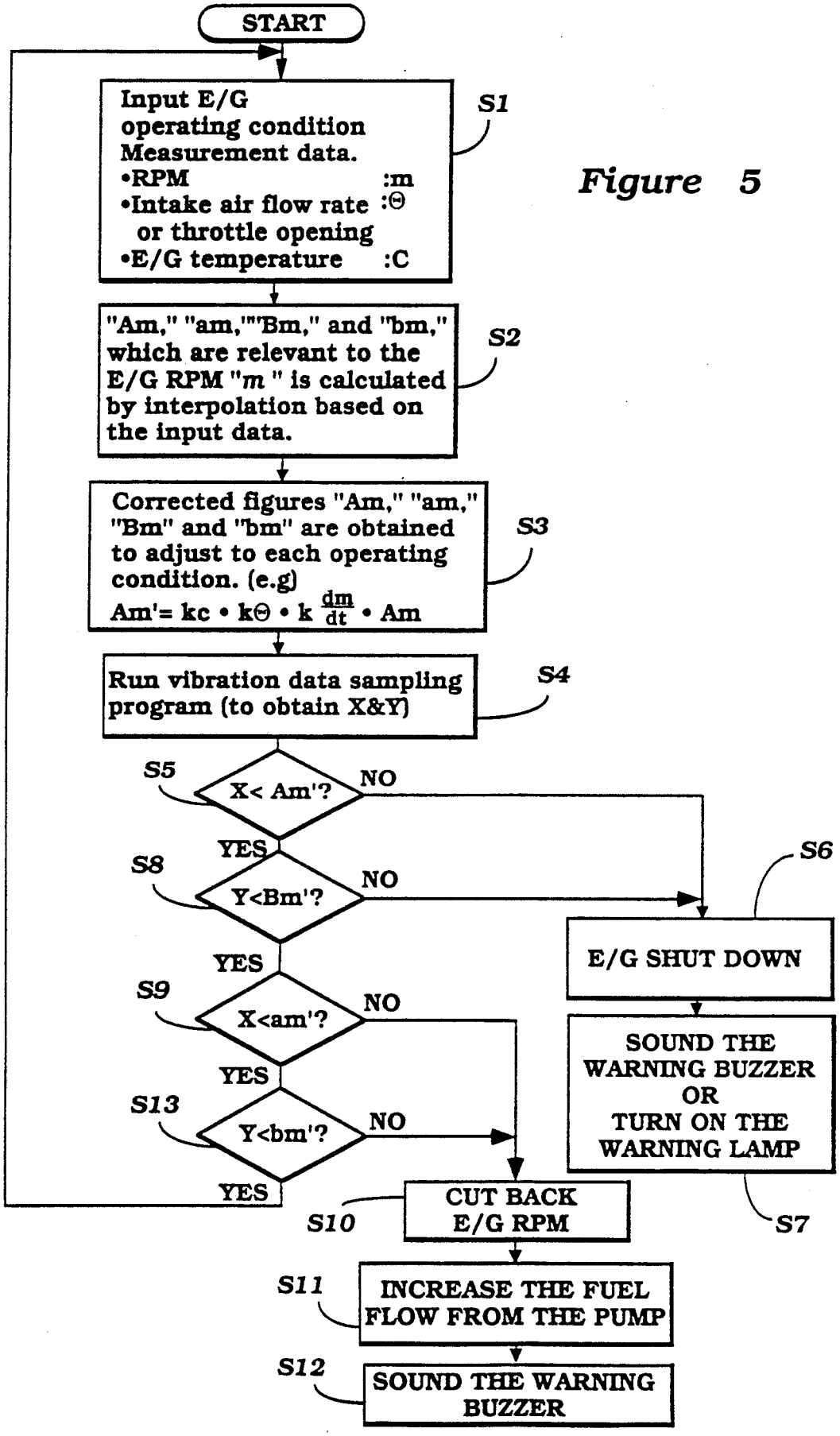
FIG. 5 is a block diagram showing the engine protection routine in accordance with an embodiment of the invention.

Furthermore, changes in engine speed such as acceleration or deceleration also can give rise to conditions that require adjustment of the values shown in FIGS. 3 and 4. FIG. 8 shows such a correction curve wherein the correction factor kdm/dt Now having this information on the background of the logic in mind, the mode of operation for protecting the engine will be described by reference to FIG. 5. FIG. 5 shows a program for the control device 37 under which it is determined if there is a condition when there is either the likelihood of engine knocking or piston scuffing likely to occur due to piston rock and protecting against these conditions.

Referring to FIG. 5, when the program starts, it moves to the step S1 wherein data is inputted indicative of the engine actual operating condition. Specifically, at the step S1 engine speed m, intake air flow or throttle opening $\theta$ and engine operating temperature c are measured and recorded. The program then moves to the step S2 wherein relevant Am, am, Bm, and bm are inputted based either upon calculations as aforenoted or the relevant data. The program then moves to the step S3 so as to correct the entered data for the operating conditions to provide Am', am', Bm' and bm'. These figures are corrected by the aforenoted constants in accordance with an equation as follows:

$$Am' = kc \cdot k\theta \cdot k\frac{dm}{dt} Am$$

Similar calculations are made for the corrected am', Am', Bm' and bm'.

The program then runs the vibration data sampling program at the step S4 so as to obtain the actual figures for vibration acceleration of the engine X and differential of vibration acceleration Y. This calculation is made in accordance with a routine as will be described in conjunction with FIG. 10.

The program then moves to the step S5 to determine if the value X of actual vibration acceleration of the engine is greater than the critical calculated value Am'. If the value of X is greater than the value of Am', then the computer senses that the engine is in a condition when piston scuffing is likely to occur and moves to the step S6 so as to provide protective action by shutting down the running of the engine in the manner as aforedescribed and to the step S7 so as to actuate the warning buzzer. The devices controlled are those indicated by the boxes 45 and 46 in FIG. 2. Also the lubricant pump 36 may be actuated to supply additional lubrication to the engine for further protection.

If, however, the measured value of X is less than the critical value Am', the program moves to the step S8 to determine if the value Y is less than the critical value Bm'. If the value of Y is greater than this critical differential of vibration acceleration, the program moves to the step S6 to achieve engine shutdown and the step S7 so as to sound the warning buzzer.

If, at both of the steps S5 and S8 it has been determined that a piston scuffing condition is not present, the program then moves to the step S9 to determine if X is less than am'. If it is not, then the control 37 realizes that the engine is operating in a condition knocking is likely to occur and protective operation is taken by moving to the step S10. In this step, the engine speed is reduced by misfiring through the control circuit 35 of FIG. 2. At the same time, the program moves to the step S11 so as to increase the supply of fuel to the engine to protect against knocking. The program then moves to the step S12 so as to sound the warning buzzer and/or warning lamp that a detrimental engine condition is being protected against.

Assuming that the vibration acceleration test has indicated that the value of X is lower than that indicative of knocking scuffing at the step S9, the program moves to the step S13 to compare the value of Y with the critical differential of vibration acceleration figure bm'. If this critical value is either equalled or exceeded, the program again moves to the steps S10, S11 and S12 so as to provide the protection aforenoted and the warning. If, however, the engine is operating in the safe range, the program moves back to the step S1 and repeats the sequence.

Figure 10:
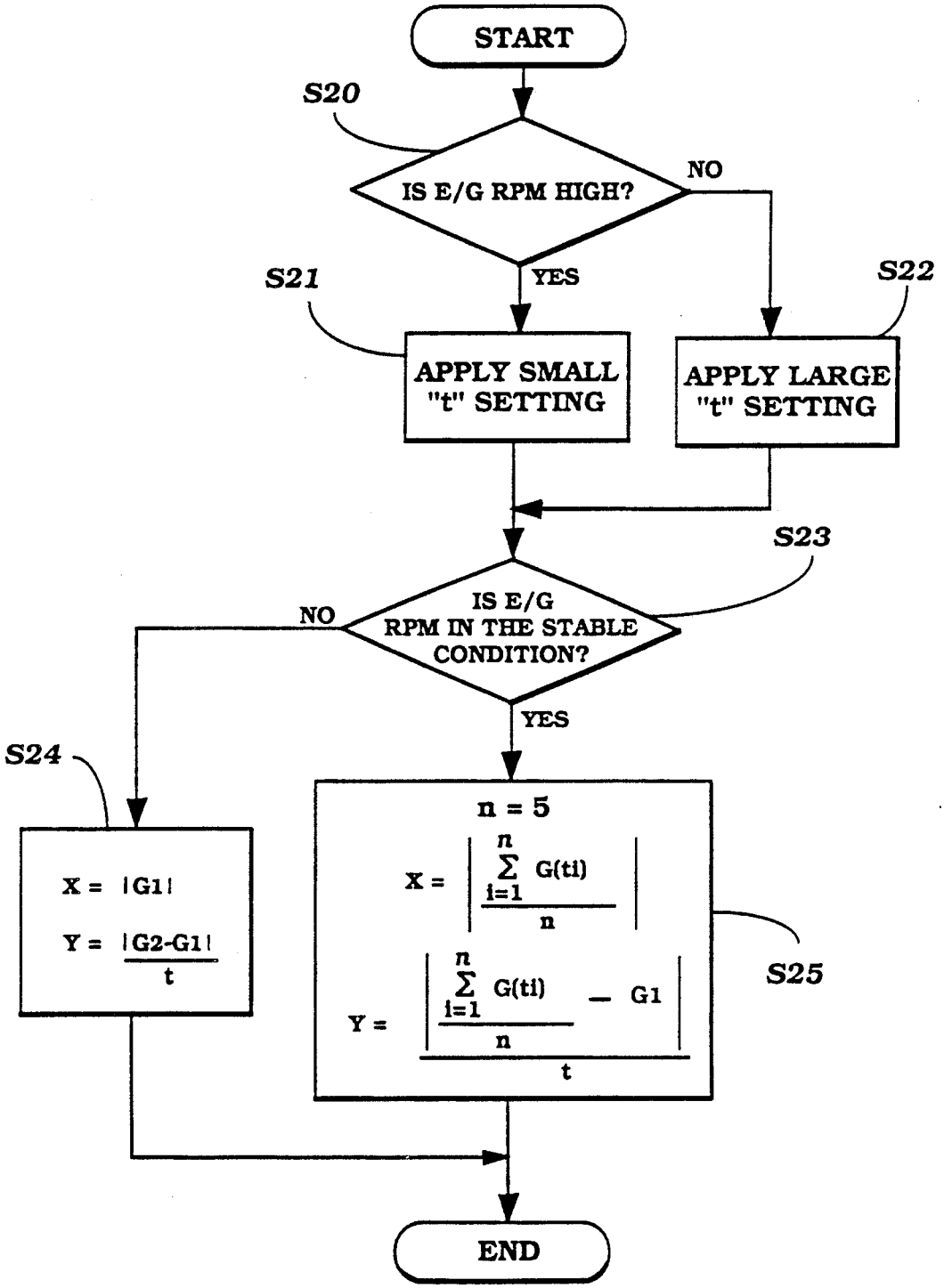
FIG. 10 is a graphic view showing how the calibration corrections are made and the routine for doing so.

The method for calculating and predicting the critical values and arriving at the values of X and Y will now be described by reference to FIG. 10. When the program starts, it moves to the step S20 to determine if the engine is operating at a high rate of speed. If it is, then the program moves to the step S21 so that it will establish a relatively short sampling time for collecting the data shown in FIG. 9. If, however, the engine speed is slow, then the time interval can be selected longer. This is done at the step S22. The program then moves to the step S23 to determine if the engine is operating in an engine speed range which is relatively stable. If it is not, the value of X and Y are set exactly as in accordance with the equations shown in step S24.

If, however, the engine is operating in the unstable speed range, then the calculations are made in accordance with the step S25 selecting an integer n that is selected so as to determine the sensitivity of the device. If n is equal to 1, the sensitivity is high whereas as the numeral n approaches 5, the sensing is not as sensitive. However, when the engine is operating in the unstable range, sensitivity should be made as high as possible. The calculations of X and Y are then made in accordance with the equations as set forth in the block S25.

From the foregoing description, it should be readily apparent that the control system and method disclosed is extremely effective in insuring against engine damage due to a variety of factors including piston scuffing and/or knocking. Of course, only one control routine and certain ways in which engine protection can be obtained have been illustrated and described. Other control routines will present themselves to those skilled in the art and such variations are deemed to be within the scope of the invention as defined by the appended claims.

I claim:

1. A control system for protecting a reciprocating engine from damage, comprising means for measuring the vibrations of the engine, means for comparing the vibrations measured with those predicted to cause detrimental operation, means for initiating protective operation of the engine to preclude damage in the event the measured vibrations exceed those determined to be detrimental to engine operation, and means for calculating the acceleration of the vibrations from the measured vibrations.

2. A control system as set forth in claim 1 wherein the differential of vibration accelerations is also calculated and actual engine vibration acceleration and differential is compared with preset values indicative of detrimental operation.

3. A control system as set forth in claim 1 wherein the means for initiating protective operation of the engine reduces at points $G_1$, $G_2$, $G_3$ at successive times $t_1$, $t_2$ and $t_3$ along the speed.

4. A control system as set forth in claim 3 wherein the means for protection of the engine further includes supplying additional fuel to the engine.

5. A control system for protecting a reciprocating engine from damage, comprising means for measuring the vibrations of the engine, means for comparing the vibrations measured with those predicted to cause piston scuffing and means for initiating protective operation of the engine to preclude piston scuffing in the event the measured vibrations exceed those determined to be detrimental to engine operation.

6. A control system as set forth in claim 5 further including means for calculating acceleration of the vibrations from the measured vibrations.

7. A control system as set forth in claim 6 wherein the differential of vibration accelerations is also calculated and actual engine vibration acceleration and differential is compared with preset values indicative of detrimental operation.

8. A control system as set forth in claim 5 wherein the protective operation of the engine comprises means for supplying additional lubricant to the engine.

9. A control system as set forth in claim 5 wherein the means for initiating protective operation of the engine reduces speed.

10. A control system as set forth in claim 9 wherein the means for protection of the engine further includes supplying additional lubricant to the engine.

11. A control method for protecting a reciprocating engine from damage, comprising the steps of measuring the vibrations of the engine, calculating the acceleration of vibrations from the measured vibrations, comparing the vibrations acceleration calculated with those predicted to cause detrimental operation, and initiating protective operation of the engine to preclude damage in the event the calculated vibrations accelerations excess those determined to be detrimental to engine operation.

12. A control means as set forth in claim 11 wherein the differential of vibration accelerations is also calculated and actual engine vibration acceleration and differential is compared with preset values indicative of detrimental operation.

13. A control means as set forth in claim 11 wherein the protective operation of the engine reduces speed.

14. A control method as set forth in claim 13 wherein the protection of the engine further includes supplying additional fuel to the engine.

15. A control means for protecting a reciprocating engine from damage, comprising the steps of measuring the vibrations of the engine, comparing the vibrations measured with those predicted to cause piston scuffing, and initiating protecting operation of the engine to preclude damage in the event the measured vibrations exceed those determined to be detrimental to engine operation.

16. A control method as set forth in claim 15 the acceleration of the vibrations is measured.

17. A control method as set forth in claim 16 wherein the differential of vibration accelerations is also calculated and actual engine vibration acceleration and differential is compared with preset values indicative of detrimental operation.

18. A control method as set forth in claim 15 wherein the protective operation of the engine comprises means for supplying additional lubricant to the engine.

19. A control means as set forth in claim 15 wherein the protective operation of the engine reduces speed.

20. A control means as set forth in claim 19 wherein the protection of the engine further includes supplying additional lubricant to the engine.

* * * * *